US005361997A

United States Patent [19]

Burkes

[11] Patent Number: 5,361,997

[45] Date of Patent: Nov. 8, 1994

[54] DISCHARGE ASSEMBLY FOR GRINDING MILLS

[75] Inventor: Daniel O. Burkes, Hibbing, Minn.

[73] Assignee: Industrial Rubber Applicators, Inc., Hibbing, Minn.

[21] Appl. No.: 44,145

[22] Filed: Apr. 7, 1993

[51] Int. Cl.[5] ..... B02C 17/18

[52] U.S. Cl. ..... 241/70; 241/183

[58] Field of Search ..... 241/70–72, 241/182, 183, 294

[56] References Cited

U.S. PATENT DOCUMENTS

| | | | |
|---|---|---|---|
| 2,259,769 | 10/1941 | Newhouse | 241/70 |
| 2,405,633 | 8/1946 | Barker et al. | 241/70 |
| 2,560,972 | 7/1951 | Martin | 241/70 |
| 2,931,584 | 4/1960 | Fairchild | 241/153 |
| 3,211,387 | 10/1965 | Russell et al. | 241/26 |
| 3,378,209 | 4/1968 | Crocheron | 241/102 |
| 3,599,882 | 8/1971 | Sabaski et al. | 241/70 |
| 3,604,638 | 9/1971 | Sabaski et al. | 241/182 |
| 3,820,727 | 6/1974 | Russell | 241/183 |
| 4,172,360 | 10/1979 | Butler | 241/70 |
| 4,231,528 | 11/1980 | Schaeffer | 241/182 |
| 4,235,386 | 11/1980 | Larsen | 241/183 |
| 4,270,705 | 6/1981 | Larsen | 241/183 |
| 4,295,615 | 10/1981 | Mishek | 241/182 |
| 4,319,719 | 3/1982 | Larsen | 241/183 |
| 4,365,763 | 12/1982 | Guerguerian | 241/70 |
| 5,055,336 | 10/1991 | Davis | 428/137 |

*Primary Examiner*—Douglas D. Watts

*Attorney, Agent, or Firm*—Westman, Champlin & Kelly

[57] ABSTRACT

A discharge assembly mounts inside a grinding mill on a mill shell at a discharge end of the mill and rotates about a longitudinal axis of the mill. The discharge assembly includes a plurality of ring sections forming an assembly covering the mill shell at the discharge end. Each ring section has an outer surface supported on the mill shell and inner surfaces forming a radially extending discharge passageway. Each ring section connects to an adjacent ring section to form a lapped joint therebetween and additional radially extending discharge passageways. Each lapped joint seals the mill shell from the discharge passageway to prevent discharged material contained therein from wearing the mill shell.

14 Claims, 5 Drawing Sheets

DISCHARGE ASSEMBLY FOR GRINDING MILLS

BACKGROUND OF THE INVENTION

This invention relates generally to a discharge assembly for material ground by attrition in a rotating mill. More particularly, the present invention provides an improved discharge assembly constructed from a plurality of sections which protect the mill from wear caused by ground material being discharged from the mill.

Grinding mills for grinding materials such as ore are well known in the art. The mills include a substantially cylindrical shell that rotates about a longitudinal axis. The shell includes lifting members facing the interior of the shell that lift the ore about the inner periphery surface toward the top of the shell when the shell is rotating. Gravity then causes the ore to tumble toward the bottom of the shell where it is reduced in size by impact with pieces of ore, lifter members or steel charge. In an autogenous grinding method, the ore is its own grinding media, whereas in a semi-autogenous method, a mixture of ore and steel charge is used to facilitate grinding.

Ore material is fed into the enclosure and ground by comminution to a desired size. After the ore is reduced to a desired size, the ore enters a plurality of discharge passageways formed in a discharge assembly through grates located at the periphery of the discharge assembly. The discharge assembly is positioned at an end opposite the feed end of the mill about a discharge trunnion and centered on the mill axis. As the shell rotates, the ground ore is transported towards the rotating axis of the shell for discharge from the mill through the discharge trunnion.

Commonly, a replaceable tubular insert is positioned in each of the discharge passageways to line the passageway and increase life by protecting the passageway from the abrasive ground ore. However, like all components located in the mill, the inserts are subject to wear from the abrasive nature of the ground ore, and thus, are susceptible to collapse, which would block the discharge passageway. Also, additional energy is required to operate the mill since the inserts add significantly to the overall weight of the mill.

In an effort to eliminate inserts, fabricated discharge assemblies were constructed wherein passageways were formed using components placed against each other in a radial fashion. However, such constructions allow ground material to leak from the chute and become located between the discharge assembly components and the mill shell. Undesirable wear occurs on the mill due to leakage of the abrasive ground materials between the components.

SUMMARY OF THE INVENTION

A discharge assembly for a grinding mill is disclosed. The discharge assembly mounts inside the mill on a mill shell at a discharge end of the mill and rotates about a longitudinal axis of the mill. The discharge assembly includes a plurality of ring sections forming an assembly covering the mill shell at the discharge end. Each ring section has an outer surface supported on the mill shell and inner surfaces forming a tubular radially extending discharge passageway. Each ring section connects to an adjacent ring section to form an overlapping joint therebetween. The lapped joint seals the mill shell from the discharge passageway preventing discharged material contained therein from leaking and wearing the mill shell.

Preferably, the inner surfaces forming the discharge passageways are coated with a material such as rubber or a ceramic that is more resistant to wear from the ground ore than the underlying material used for the ring section. The material thus reduces wear upon each of the ring sections, thereby extending the useful life of the discharge assembly. In addition, the contacting surfaces of the lapped joint include a layer of the coating material to form an effective seal therebetween to further seal the lapped joint and prevent leakage of ground ore from the discharge passageways. In a preferred embodiment, the surfaces of each ring section supported on the mill shell are also covered with the material to further protect the mill shell.

In a further preferred embodiment, the discharge assembly includes a plurality of outer ring sections forming an outer ring assembly and a plurality of inner ring sections forming an inner ring assembly, the inner ring assembly being formed closer to the longitudinal axis of the mill than the outer ring assembly. Each ring section of the outer and inner ring assemblies has an outer surface supported on the mill shell and inner surfaces forming tubular discharge passageways. Each ring section is connected to an adjacent ring section to form a lapped joint therebetween. The lapped joint seals the discharge passageways from the mill shell to prevent ground material from leaking and contacting the mill shell and causing undesirable wear. The discharge passageways are radially oriented and aligned with each other so that ground material flows freely through the outer and inner ring assemblies to exit the mill.

DETAILED DESCRIPTION OF THE PREFERRED EMBODIMENTS

Figure 1:
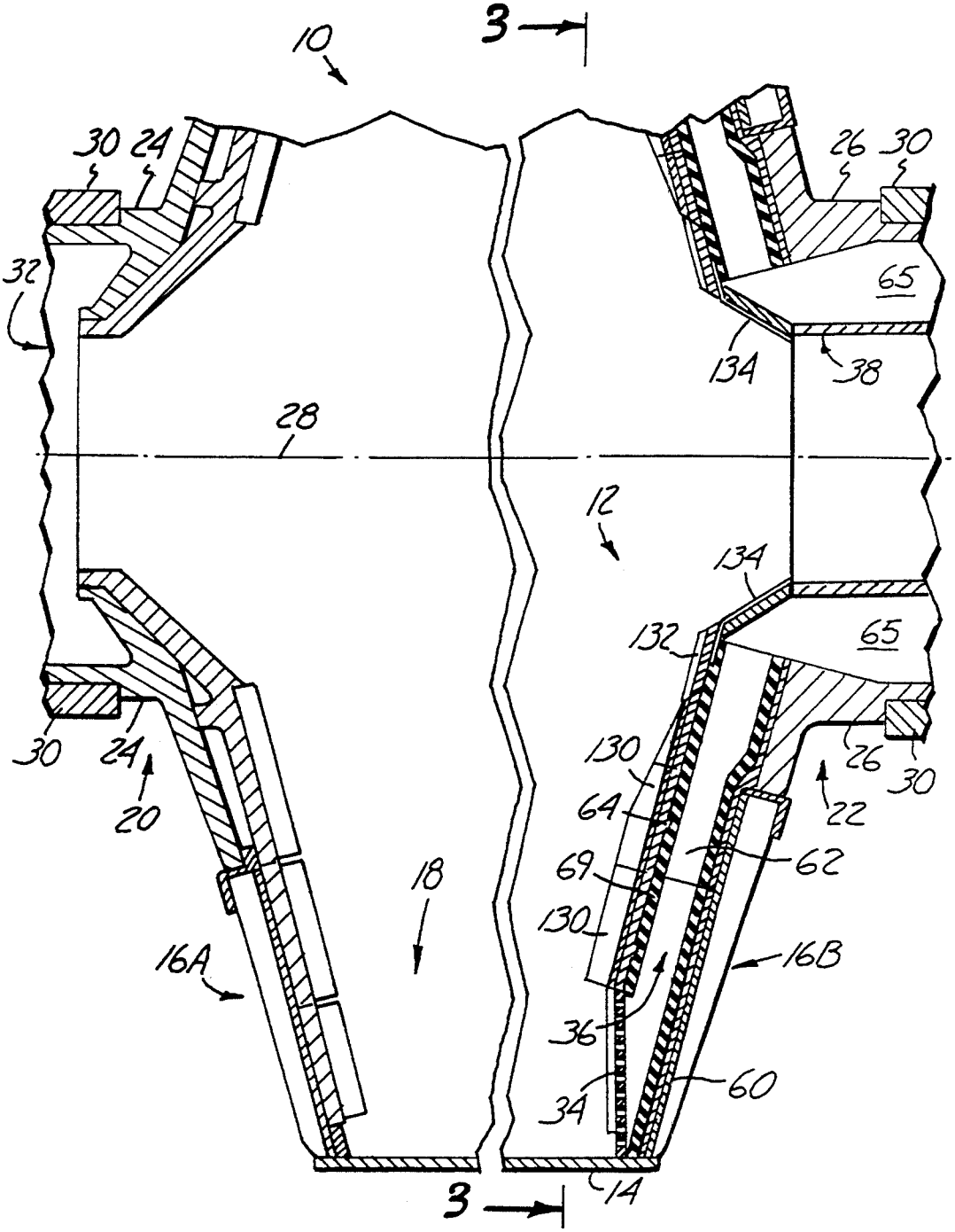
FIG. 1 is a side elevation of a grinding mill in partial cross-section and broken away illustrating the discharge assembly of the present invention.

A grinding mill, generally indicated at 10 in FIG. 1, includes a discharge assembly 12 of the present invention. The mill 10 includes a shell having a cylindrical shell portion 14 and tapered end portions 16A and 16B joined to the cylindrical portion 14 at opposite ends 20 and 22 of the mill 10 to form a grinding chamber 18. Each of the ends 20 and 22 of the mill 10 include a trunnion 24 and 26, respectively, that supports the mill 10 for rotation about an axis 28 on bearings 30 in a conventional manner.

Generally, the end 20 includes a feed chute 32 extending within the trunnion 24 through which ore is introduced into the grinding chamber 18 and ground to a desired size. The discharge assembly 12 includes discharge passageways, generally indicated at 36, for the ground material to exit the grinding mill 10 through a discharge opening 65 in the trunnion 26. The discharge passageways 36 are connected to periphery grates 34 spaced radially from the rotational axis 28. The grates 34 provide access for the ground ore to the discharge passageways 36 from the grinding chamber 18. A return tube 38 returns ground material to the grinding chamber 18 if further grinding is desired.

Figure 2:
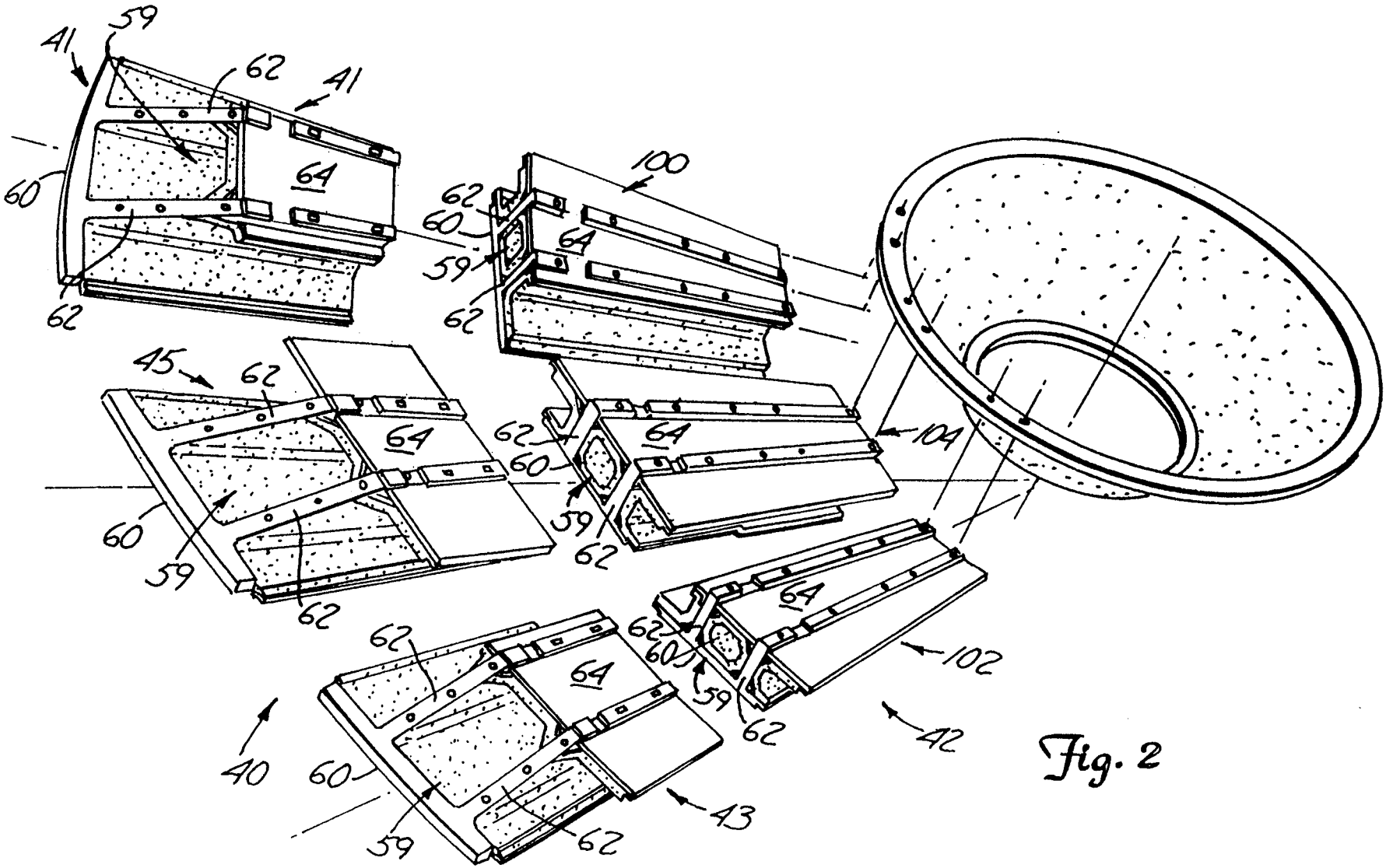
FIG. 2 is a partial exploded perspective view of the discharge assembly.
Figure 3:
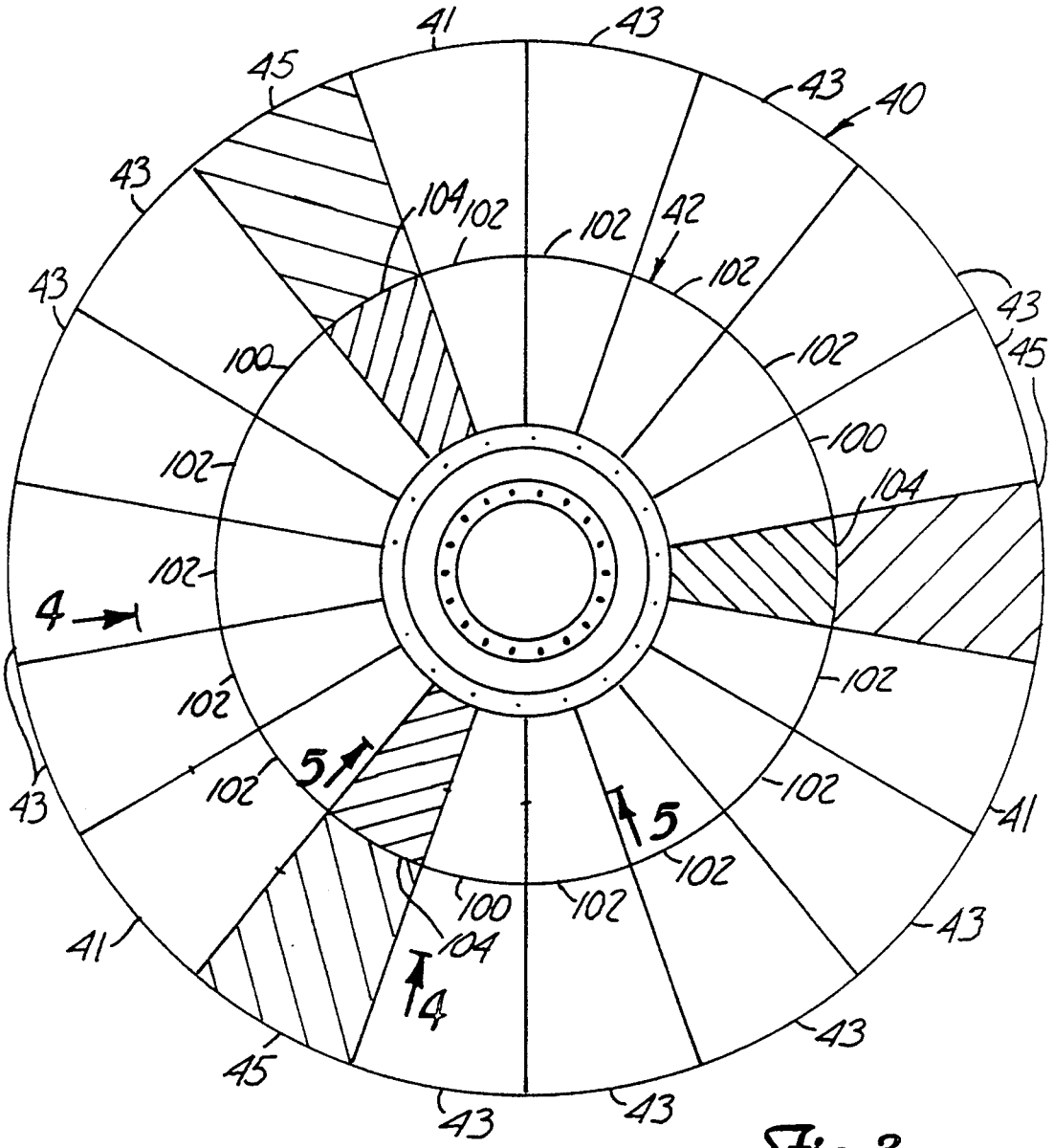
FIG. 3 is a schematic representation of the discharge assembly.

Referring also to FIGS. 2 and 3, the discharge assembly 12 comprises a plurality of ring sections angularly positioned and joined together about the rotational axis 28 to form the discharge passageways 36. Preferably, the discharge assembly 12 includes an outer ring assembly 40 formed from a first plurality of ring sections and an inner ring assembly 42 formed from a second plurality of ring sections. By using two ring assemblies, the overall size and thus weight of each ring section forming the discharge assembly is reduced allowing easier installation. However, although the embodiment illustrated shows two ring assemblies 40 and 42, the discharge assembly 12 can be formed from one ring assembly or include additional ring assemblies, if desired.

Figure 4:
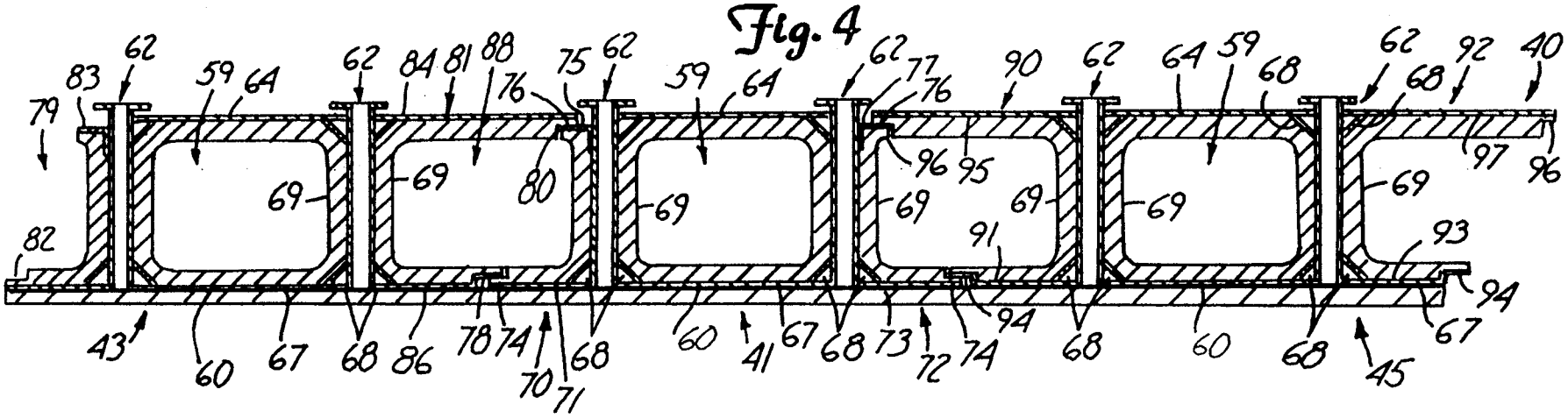
FIG. 4 is a sectional view taken along line 4—4 in FIG. 3.
Figure 5:
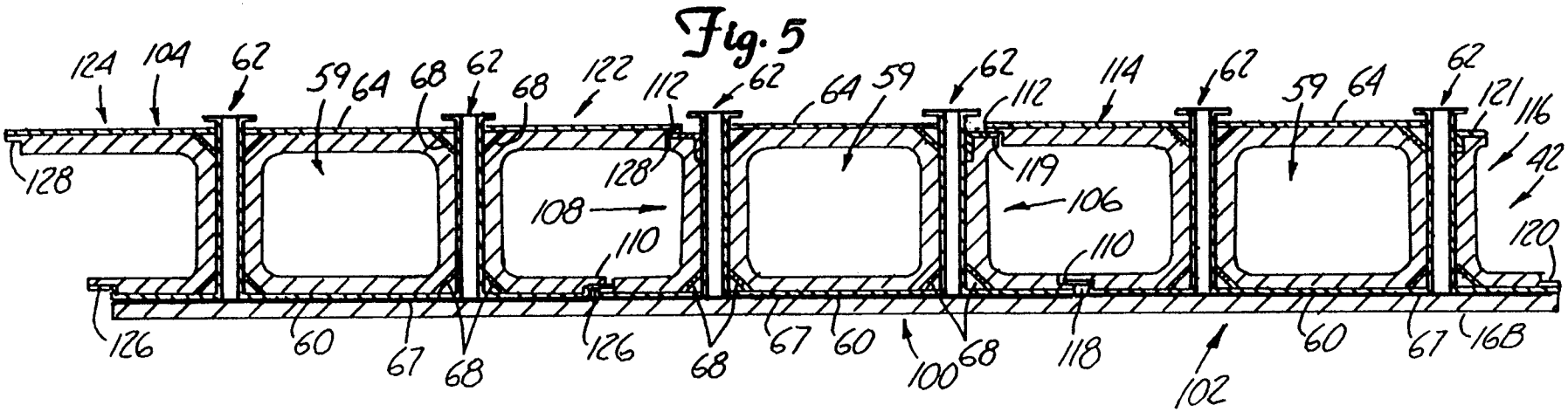
FIG. 5 is a sectional view taken along line 5—5 in FIG. 3.

With reference to FIGS. 1 and 2, the ring sections of the discharge assembly 12 are mounted to the end 22 of the mill 10 to cover the mill shell 16B from material ground in the grinding Chamber 18. Preferably, each ring section of both the outer ring assembly 40 and the inner ring assembly 42, as illustrated in FIGS. 4 and 5, includes an enclosed discharge passageway 59. The enclosed discharge passageway 59 comprises a wall 60 mounted adjacent the mill shell 16B and a plate portion 64. A pair of divider walls 62 are formed from suitable plates and extend from the wall 60 of each ring section to the plate portion 64. The divider walls 62 are secured to the wall 60 through conventional means such as welding. Referring to FIGS. 4 and 5, angled support plates 68 welded between the wall 60 and the divider wall 62 and between the plate portion 64 and the divider wall 62 on opposite sides of each divider wall 62 extend the length of the ring sections to provide additional support. The enclosed discharge passageways 59 formed between the divider walls 62, the plate 64 and the wall 60 are coated with a suitable material covering 69, preferably rubber, although a ceramic material also can be used, to reduce wear on the wall surfaces when ground ore is transported therethrough. In the embodiment illustrated, the material further forms a layer or covering 67 that is disposed between each of the ring sections and the mill shell 16B to prevent ground ore contacting the mill shell 16B. Preferably, the covering 67 comprises a layer of material attached to the outer surface of each ring section.

FIGS. 4 and 5 further illustrate that each ring assembly 40 and 42, respectively, comprises three structurally different ring sections. The ring sections are mounted adjacent each other and include walls extending outwardly from the divider walls 62 which have overlapping edge portions that fit with edges of walls of adjacent ring sections to cooperate in order to form additional discharge passageways on opposite sides of the enclosed passageways 59. Referring first to the outer ring assembly 40, a first ring section is indicated generally at 41 and includes side wall portions 70 and 72 mounted on opposite sides of the divider walls 62. The side wall portions 70 and 72 include plates 71 and 73, respectively, secured to the divider walls 62, preferably with the angled support plates 68 discussed above. Brackets 75 and 77 are attached on opposite sides of the divider walls 62 with a layer of more wear resistant material such as rubber applied thereover. The first ring section 41 is characterized in that the side wall portions 70 and 72 have outwardly facing lap surfaces 74 and 76 relative to the mill shell 16B. The lap surfaces 74 are on the plates 71 and 73, while the lap surfaces 76 are on the brackets 75 and 77. Preferably, the lap surfaces are substantially co-planar with respect to each other with each pair spaced equal distances from the mill shell 16B.

A second ring section 43 is mounted adjacent side wall portion 70 of the first ring section 41 to engage lap surfaces 74 and 76. The second ring section 43 is characterized by non-coplaner lap surfaces in that the lap surfaces include inwardly facing lap surfaces 78 and 80 on a side wall portion 81 that engage lap surfaces 74 and 76, respectively, while on a side wall portion 79 outwardly facing lap surfaces 82 and 83 are present. In other words, the lap surfaces 78 and 82, and the lap surfaces 80 and 83 are complementary in that each face opposite directions spaced from the mill shell 16B by differing amounts. The side wall portion 79 is similar to that of side wall portion 70 of ring section 41. As illustrated, the side wall portion 81 has a plate 84 mounted to the dividerwall 62 to extend to and overlap with bracket 75 of ring section 41. Similarly, a plate 86 is mounted to the divider wall 62 to extend to and overlap with the plate 71. The overlapping structure thus defines an additional sealed radial passageway 88 between adjacent ring sections through which ground ore is discharged from the mill. Preferably, the inner surfaces of passageway 88 and lap surfaces are coated with a more wear resistant material 69 to reduce wear and to form an effective seal along the joint to prevent leakage of the ground ore from the passageway 88.

Referring to FIG. 3, additional ring sections of the type indicated at 43 and described above are joined to continue formation of the ring assembly 40 in a clockwise direction. Since each of these ring sections have side wall portions 79 and 81 that are complementary, the ring sections are joined in manner as described above with respect to ring sections 41 and 43 to form additional sealed discharge passageways between adjacent ring sections on opposite sides of the enclosed passageways 59 of such ring sections.

A third ring section is indicated generally at 45 and includes side wall portions 90 and 92 mounted on opposite sides of the divider walls 62. The side wall portions 90 and 92 include plates 91 and 93, respectively, secured to the divider walls 62, preferably with the angled support plates 68 discussed above. Plates 95 and 97 are similarly attached on opposite sides of the divider walls 62 with a layer of more wear resistant material applied thereover. The third ring section 45 is characterized in that the side wall portions 90 and 92 have inwardly facing lap surfaces 94 and 96 relative to the mill shell 16B. The lap surfaces 94 are on the plates 91 and 93, while the lap surfaces 96 are on the plates 95 and 97. Preferably, the lap surfaces are substantially co-planar with respect to each other with each pair spaced equal distances from the mill shell 16B. Referring also to FIG. 3, the third ring section 45 engages a side wall portion 72 on the ring section 41 and a side wall portion 79 on the ring section 43 to form two additional sealed discharge passageways and complete the construction of the ring assembly 40. Although at a minimum the ring assembly 40 can be formed using one of each of the ring sections 41 and 45 with the remaining ring sections being of the type indicated at 43, preferably, as illustrated in FIG. 3 the ring assembly 40 includes three first ring sections 41 and three third ring sections 45 joined in pairs and spaced apart at equal angular intervals.

It should be understood that the enclosed discharge passageway 59 can be omitted with all discharge passageways of the discharge assembly formed by sealed discharge passageways between adjacent ring sections. In other words, a single divider wall 62 can be used with opposite side surfaces being used to form the corresponding sealed discharge passageways.

The inner ring assembly 42 is similarly formed from a plurality of ring sections comprising three different ring sections 100, 102 and 104. The ring section 100 is similar to the ring section 41 of the outer ring assembly 40 and is characterized by side wall portions 106 and 108 having lap surfaces 110 and 112 facing away from the mill shell 16B. The ring section 102 is similar to the ring section 43 and is characterized by side wall portions 114 and 116 having lap surfaces 118 and 119, and, 120 and 121, respectively, toward and away from the mill shell 16B. The ring section 104 is similar to the ring section 45 and is characterized by side wall portions 122 and 124 having lap surfaces 126 and 128 facing the mill shell 16B. Preferably, as illustrated in FIG. 3, the ring assembly 42 includes three ring sections 100 and three ring sections 104 joined together in pairs and spaced apart at equal angular intervals. A sufficient number of ring sections 102 are used to complete the inner ring assembly 42.

Figure 6:
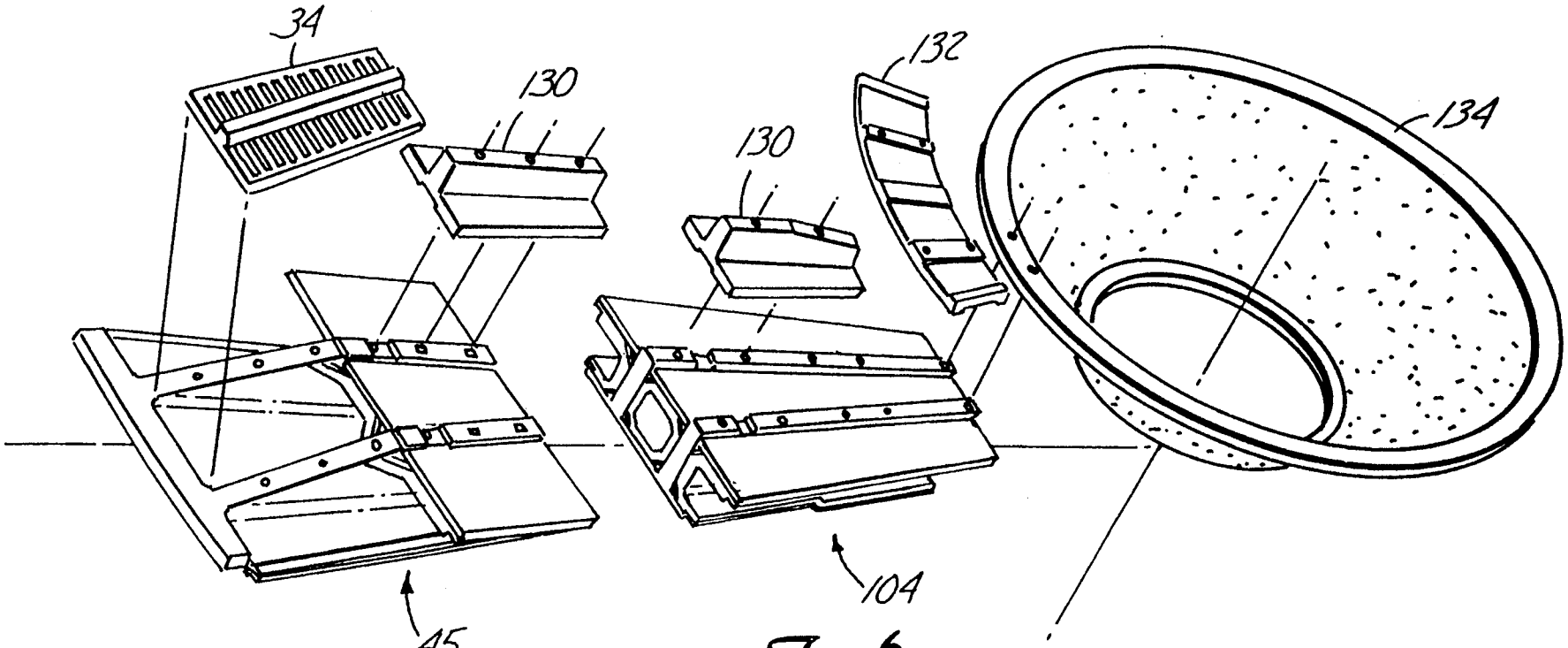
FIG. 6 is a partial exploded perspective view of the discharge assembly.

Referring to FIG. 6, lifter bars 130 are conventionally attached to each of the divider walls 62 adjacent the plate 64 of each sing section in both the outer and inner ring assemblies 40 and 42. A plurality of guard plates 132 located between the lifter bars 130 of the inner ring assembly 42 and a discharge cone 134 protect the inner ring assembly 42 and further secures the discharge assembly 12 to the discharge cone 134. The discharge cone 134, which may be either a single unitary piece or divided into sections and attached to form a complete piece, provides a passageway between the discharge passageways 36 and the discharge opening 65. Preferably, the discharge cone 134 is coated on both sides with a suitable material to reduce wear.

In summary, the discharge assembly of the present invention provides a plurality of sealed discharge passageways from individual grate openings to the discharge opening of the grinding mill. Each of the sealed discharge passageways are lined with a less wear-resistant material, such as rubber, to reduce wear and extend the operational life of the discharge assembly. The discharge assembly being formed from two concentric ring assemblies reduces the overall weight of the discharge assembly thereby improving operational efficiency.

Although the present invention has been described with reference to preferred embodiments, workers skilled in the art will recognize that changes may be made in form and detail without departing from the spirit and scope of the invention.

What is claimed is:

1. A discharge assembly for use in a mill rotating about a longitudinal axis, the discharge assembly being mounted inside the mill on a mill shell at a discharge end of the mill, the discharge assembly comprising:

a first plurality of ring sections forming a ring assembly covering the mill shell at the discharge end, wherein each ring section has a first end and a second end with a first surface supported on the mill shell and a second surface forming a radially extending discharge passageway, and wherein each ring section connects to an adjacent ring section to form a lapped joint therebetween from the first end to the second end, the lapped joint having a layer of compressible material for sealing the discharge passageway from the mill shell.

2. The discharge assembly as specified in claim 1 wherein the second surfaces forming the discharge passageway are coated with the compressible material.

3. The discharge assembly as specified in claim 2 wherein the compressible material is rubber.

4. The discharge assembly as specified in claim 1 wherein each ring section includes two spaced apart walls substantially perpendicular to the mill shell, the discharge passageway being formed therebetween.

5. The discharge assembly as specified in claim 4 wherein at least one ring section of the plurality of ring sections includes lap portions on opposite radial side edges of the ring section, the lap portions facing and being spaced apart from the mill shell.

6. The discharge assembly as specified in claim 4 wherein at least one ring section of the plurality of ring sections includes extending lap portions on opposite radial side edges of the ring section, the lap portions facing away from the mill shell.

7. The discharge assembly as specified in claim 4 wherein at least one ring section of the plurality of ring sections includes oppositely facing lap portions on opposite radial side edges of the ring section, wherein one of the lap portions faces the mill shell and the other of the lap portions faces away from the mill shell.

8. The discharge assembly as specified in claim 6 wherein at least two first type ring sections of the plurality of ring sections include first lap portions on opposite radial side edges of each first type ring section facing the mill shell; and wherein at least two second type ring sections of the plurality of ring sections include second lap portions on opposite radial side edges of the second type ring section facing away from the mill shell.

9. The discharge assembly as specified in claim 1 wherein the compressible material is rubber.

10. The discharge assembly as specified in claim 1, further comprising a second plurality of ring sections forming an inner ring covering the mill shell at the discharge end positioned between the first plurality of ring sections and the longitudinal axis.

11. The discharge assembly as specified in claim 10, wherein each of the second plurality of ring sections includes a first surface supported on the mill shell and a second surface forming a radially extending discharge passageway which communicates with the discharge passageway of the first plurality, and wherein each of the second plurality of ring sections connects to an adjacent ring section to form a lapped joint therebetween, the lapped joint sealing the inner discharge passageway from the mill shell.

12. A discharge assembly for use in a mill rotating about a longitudinal axis, the discharge assembly mounted inside the mill on a mill shell at a discharge end of the mill, the discharge assembly comprising:

a plurality of outer ring sections forming an outer ring assembly covering the mill shell at the discharge end, wherein each outer ring section has a first end and a second end with an outer surface supported on the mill shell and inner surfaces forming a radially extending outer discharge passageway, and wherein each outer ring section connects to an adjacent outer ring section to form a lapped joint therebetween from the first end to the second end, the lapped joint having a layer of compressible material for sealing the mill shell from the outer discharge passageway; and a plurality of inner ring sections forming an inner ring assembly covering the mill shell at the discharge end, wherein each inner ring section has a first end and a second end with an outer surface supported on the mill shell and an inner surfaces forming a radially extending inner discharge passageway, and wherein each inner ring section connects to an adjacent inner ring section to form a lapped joint therebetween from the first end to the second end, the lapped joint having a layer of compressible material for sealing the mill shell from the inner discharge passageway, the inner ring formed radially inward toward the longitudinal axis from the outer ring with the inner discharge passageway communicating with the outer discharge passageway.

13. The discharge assembly as specified in claim 12 wherein each ring section includes an enclosed wall structure forming a second discharge passageway.

14. The discharge assembly as specified in claim 13 wherein the inner and outer discharge passageways are formed with corresponding lapped joints between adjacent ring sections, the lapped joints joining portions of adjacent ring sections.

* * * * *

UNITED STATES PATENT AND TRADEMARK OFFICE

CERTIFICATE OF CORRECTION

PATENT NO. : 5,361,997

DATED : November 8, 1994

INVENTOR(S) : Daniel O. Burkes

It is certified that error appears in the above-indentified patent and that said Letters Patent is hereby corrected as shown below:

On the title page

Under [56] References Cited, U.S. PATENT DOCUMENTS, please delete

"4,172,360 10/1979 Butler 241/70"

and insert

--4,172,560 10/1979 Butler 241/70--

Signed and Sealed this

Twenty-first Day of February, 1995

*Attest:*

*Attesting Officer*

BRUCE LEHMAN

*Commissioner of Patents and Trademarks*